US010661522B2

(12) United States Patent
Fukuda

(10) Patent No.: US 10,661,522 B2
(45) Date of Patent: May 26, 2020

(54) MULTILAYER-TYPE SHEET PROCESSING APPARATUS

(71) Applicant: NIHON SEIZUKI KOGYO CO., LTD., Osaka (JP)

(72) Inventor: Masanori Fukuda, Osaka (JP)

(73) Assignee: NIHON SEIZUKI KOGYO CO., LTD., Osaka (JP)

( * ) Notice: Subject to any disclaimer, the term of this patent is extended or adjusted under 35 U.S.C. 154(b) by 0 days.

(21) Appl. No.: 16/300,282

(22) PCT Filed: Dec. 27, 2017

(86) PCT No.: PCT/JP2017/047043
§ 371 (c)(1),
(2) Date: Nov. 9, 2018

(87) PCT Pub. No.: WO2019/008795
PCT Pub. Date: Jan. 10, 2019

(65) Prior Publication Data

US 2019/0381753 A1 Dec. 19, 2019

(30) Foreign Application Priority Data

Jul. 6, 2017 (JP) ..... 2017-132638

(51) Int. Cl.
*B31B 50/00* (2017.01)
*B31B 50/20* (2017.01)
(Continued)

(52) U.S. Cl.
CPC ..... *B31B 50/005* (2017.08); *B31B 50/042* (2017.08); *B31B 50/20* (2017.08);
(Continued)

(58) Field of Classification Search
CPC .... B26D 3/08; B26D 11/00; B26D 2007/267; B26D 2007/2657; B26D 2007/206;
(Continued)

(56) References Cited

U.S. PATENT DOCUMENTS 3,470,780 A * 10/1969 Norman ..... B26D 7/0006 83/375
3,731,648 A * 5/1973 Gerber ..... B26D 7/27 118/697
(Continued)

FOREIGN PATENT DOCUMENTS

DE 4039827 A1 * 6/1992 ..... B23Q 5/00
JP 6-270099 9/1994
(Continued)

OTHER PUBLICATIONS

Decision to Grant a Patent dated Oct. 31, 2017 in corresponding Japanese Application No. 2017-132638, with English translation.
(Continued)

*Primary Examiner* — Stephen F. Gerrity
*Assistant Examiner* — Joshua G Kotis
(74) *Attorney, Agent, or Firm* — Wenderoth, Lind & Ponack, L.L.P.

(57) ABSTRACT

A multilayer-type sheet processing apparatus includes processing units. Each of the processing units includes first guide members extending in an X-direction, first moving bodies arranged on the first guide members, second guide members supported to the first moving bodies and extending in a Y-direction, second moving bodies arranged on the second guide members, Y-drive mechanisms configured to drive the second moving bodies along the second guide members, work areas each arranged in a plane including the X- and Y-directions, and tools, which are arranged in the second moving bodies to be able to move close to and
(Continued)

separate away from the work areas, and are each configured to form a processing line on a sheet arranged on a work area. The first moving body that is moved by the X-drive mechanism and the first moving bodies of the other units are coupled to each other.

7 Claims, 11 Drawing Sheets

(51) Int. Cl.

| | |
|---|---|
| ***B31B 50/04*** | (2017.01) |
| ***B31B 50/25*** | (2017.01) |
| *B31B 120/30* | (2017.01) |
| *B31B 110/35* | (2017.01) |
| *B31B 50/07* | (2017.01) |
| *B26D 11/00* | (2006.01) |

(52) U.S. Cl.
CPC ..... *B31B 50/25* (2017.08); *B26D 11/00* (2013.01); *B31B 50/07* (2017.08); *B31B 2110/35* (2017.08); *B31B 2120/302* (2017.08)

(58) Field of Classification Search
CPC ..... B26F 1/3813; B26F 1/3806; B26F 1/382; B31B 50/14; B31B 50/144; B31B 50/16; B31B 50/18; B31B 50/20; B31B 50/22; B31B 50/25; B31B 50/254; B31B 50/005; B31B 70/16; B31B 70/18; B31B 70/20; B31B 70/144; B31B 70/254; B23D 7/02; B23D 7/06; B29C 66/843; B65B 65/006
USPC ..... 493/340, 361, 372, 468, 473, 477, 479, 493/480; 83/940, 941, 565, 549
See application file for complete search history.

(56) References Cited

U.S. PATENT DOCUMENTS

| | | | | |
|---|---|---|---|---|
| 3,831,502 | A * | 8/1974 | Tokuno | B23D 35/008 493/353 |
| 4,070,890 | A | 1/1978 | Stubbings | |
| 4,133,234 | A * | 1/1979 | Gerber | B26D 5/00 83/56 |
| 4,214,495 | A * | 7/1980 | Coburn | B26D 7/2635 493/342 |
| 4,328,727 | A * | 5/1982 | Tokuno | B23D 35/008 83/106 |
| 4,993,296 | A * | 2/1991 | Nasu | B23Q 5/34 83/422 |
| 6,173,211 | B1 * | 1/2001 | Williams | A41H 3/08 700/131 |
| 6,245,004 | B1 * | 6/2001 | Waters | B26F 1/3813 493/473 |
| 6,840,898 | B2 * | 1/2005 | Pettersson | G05B 19/19 493/473 |
| 2011/0061787 | A1 | 3/2011 | Cummins et al. | |
| 2014/0130325 | A1 | 5/2014 | Cummins et al. | |
| 2018/0264766 | A1 * | 9/2018 | Veis | B31B 50/005 |

FOREIGN PATENT DOCUMENTS

| | | |
|---|---|---|
| JP | 7-24785 | 1/1995 |
| JP | 2005-230917 | 9/2005 |
| JP | 2013-504446 | 2/2013 |

OTHER PUBLICATIONS

Notification of Reason for Refusal dated Oct. 10, 2017 in corresponding Japanese Application No. 2017-132638, with English translation.
Written Opinion of the International Searching Authority dated Feb. 13, 2019 in International (PCT) Patent Application No. PCT/JP2017/047043.

* cited by examiner

MULTILAYER-TYPE SHEET PROCESSING APPARATUS

TECHNICAL FIELD

The present invention relates to a multilayer-type sheet processing apparatus comprising a plurality of processing units, which are stacked on one another and are each configured to perform, for example, cutting on a sheet such as cardboard.

BACKGROUND ART

There has hitherto been performed work of creasing and cutting sheets of paper such as cardboard, a corrugated board, and a paper board, sheets of leather, or sheets of plastic and assembling the processed sheets to obtain a packing box or a display for use. The creasing and cutting on a sheet are generally performed through use of a punching die or a cutting plotter.

For example, in Patent Literature 1, there is described a cutting plotter configured to cut a sheet into a desired shape through drive of a sheet in a first direction and drive of a blade in a second direction orthogonal to the first direction. Further, in Patent Literature 2, there is described a method of cutting a sheet by moving a cutter in an X-direction and a Y-direction.

CITATION LIST

Patent Literature 1: JP 2005-230917 A
Patent Literature 2: JP 7-24785 A

SUMMARY OF INVENTION

Technical Problem

Not only the apparatus of Patent Literatures 1 and 2 but also all related-art sheet processing apparatus are each configured to process (perform creasing and cutting on) one sheet in a two-dimensional plane defined in the X-direction and Y-direction. Therefore, there is a limit to increase in speed of the apparatus, and hence improvement in productivity has been required.

In view of the above, an object of the present invention is to provide a multilayer-type sheet processing apparatus capable of remarkably improving productivity while an installation area is the same as that of the related-art sheet processing apparatus.

Solution to Problem

In order to achieve the above-mentioned object, according to one embodiment of the present invention, provided is a multilayer-type sheet processing apparatus, comprising a processing unit comprising: a first guide member extending in an X-direction; a first moving body arranged so as to be movable along the first guide member; a second guide member, which is supported to the first moving body and extends in a Y-direction orthogonal to the X-direction; a second moving body arranged so as to be movable along the second guide member; a Y-drive mechanism configured to drive the second moving body along the second guide member; a work area arranged in a plane including the X-direction and the Y-direction; and a tool, which is arranged in the second moving body so as to be able to move close to and separate away from the work area, and is configured to form a processing line on a sheet arranged on the work area, wherein the processing unit comprises a plurality of the processing units being each stacked so that the work areas overlap with each other in a direction perpendicular to the X-direction and the Y-direction, wherein the first moving body of at least one processing unit of the plurality of processing units is driven along the first guide member by an X-drive mechanism, and wherein the first moving body that is moved by the X-drive mechanism and the first moving body of another processing unit comprising no X-drive mechanism are coupled to each other.

Advantageous Effects of Invention

According to the one embodiment of the present invention, the plurality of processing units are stacked. Moreover, the first moving body of at least one unit is driven along the first guide member by the X-drive mechanism, and the first moving body that is moved by the X-drive mechanism and the first moving body of another unit are coupled to each other. Therefore, the productivity can be remarkably improved while an installation area is the same as that of the related-art sheet processing apparatus.

DESCRIPTION OF EMBODIMENTS

Outline of Sheet Processing Apparatus

Now, a multilayer-type sheet processing apparatus according to an embodiment of the present invention is described with reference to the drawings. As illustrated in FIG. 1 to FIG. 3B, a multilayer-type sheet processing apparatus 100 has a three-layer structure in which three processing units 11 to 13 having common basic structures are stacked in an up-and-down direction at equal intervals. The processing units 11 to 13 comprise horizontal machine frames 11*a* to 13*a*, and corner portions at four corners of each of the machine frames 11*a* to 13*a* are coupled to support columns 21 to 24 arranged at four corners of the multilayer-type sheet processing apparatus 100.

The machine frames 11*a* to 13*a* of the processing units 11 to 13 have a rectangular shape each in plan view, and rollers R are arranged on sides, which are anteroposteriorly opposed to each other, of each of the rectangular machine frames 11*a* to 13*a*. The rollers R are provided in parallel to each other, and conveying belts 31 to 33 are stretched between the rollers R. The conveying belts 31 to 33 each have an air suction structure formed of, for example, a punched steel belt. The conveying belts 31 to 33 are configured to suck and attract sheets S set on the conveying belts 31 to 33, and can retain the sheets S reliably at predetermined positions without positional displacement.

Figure 1:
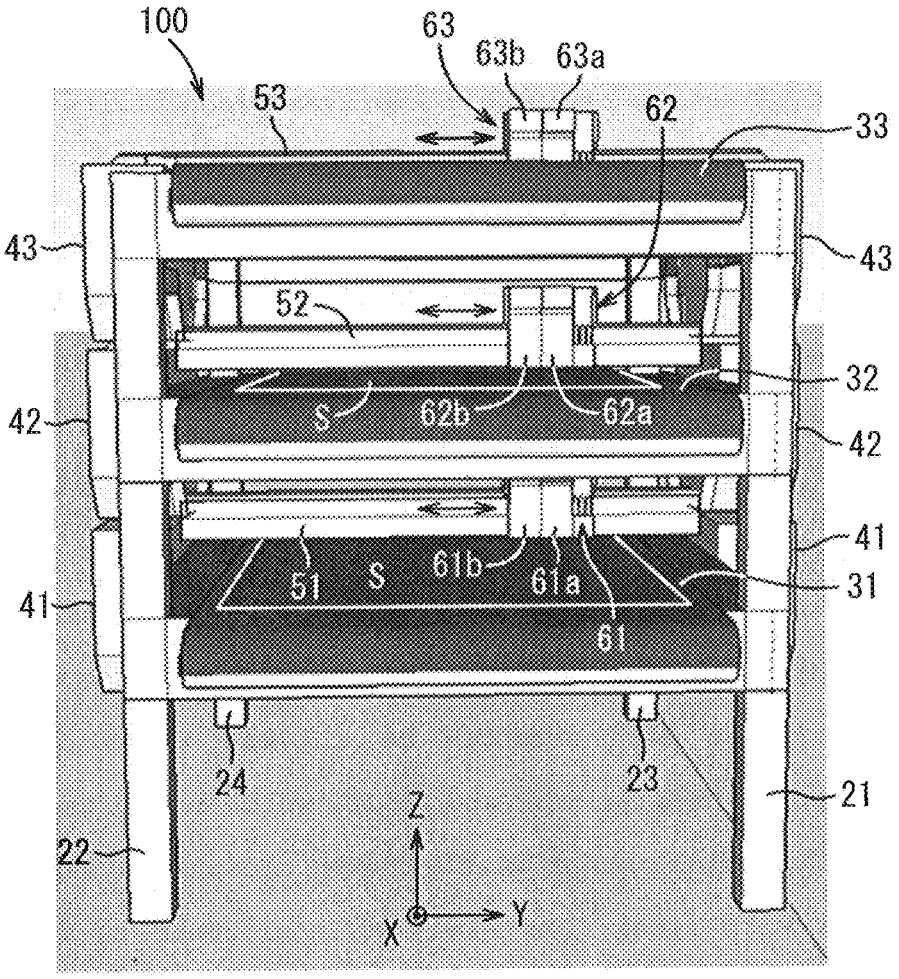
FIG. 1 is a front view of a multilayer-type sheet processing apparatus according to an embodiment of the present invention.
Figure 2A:
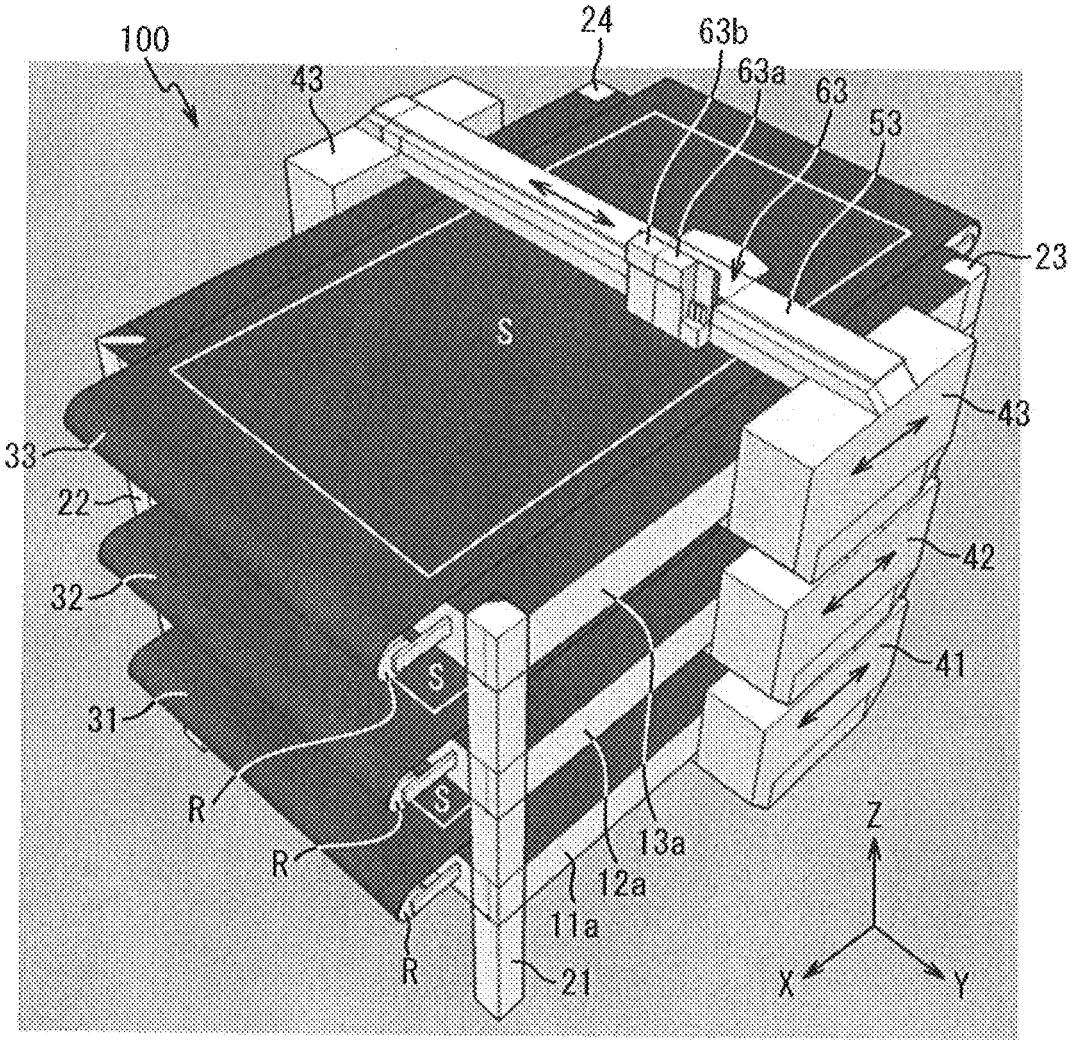
FIG. 2A is a first front perspective view of the multilayer-type sheet processing apparatus.
Figure 2B:
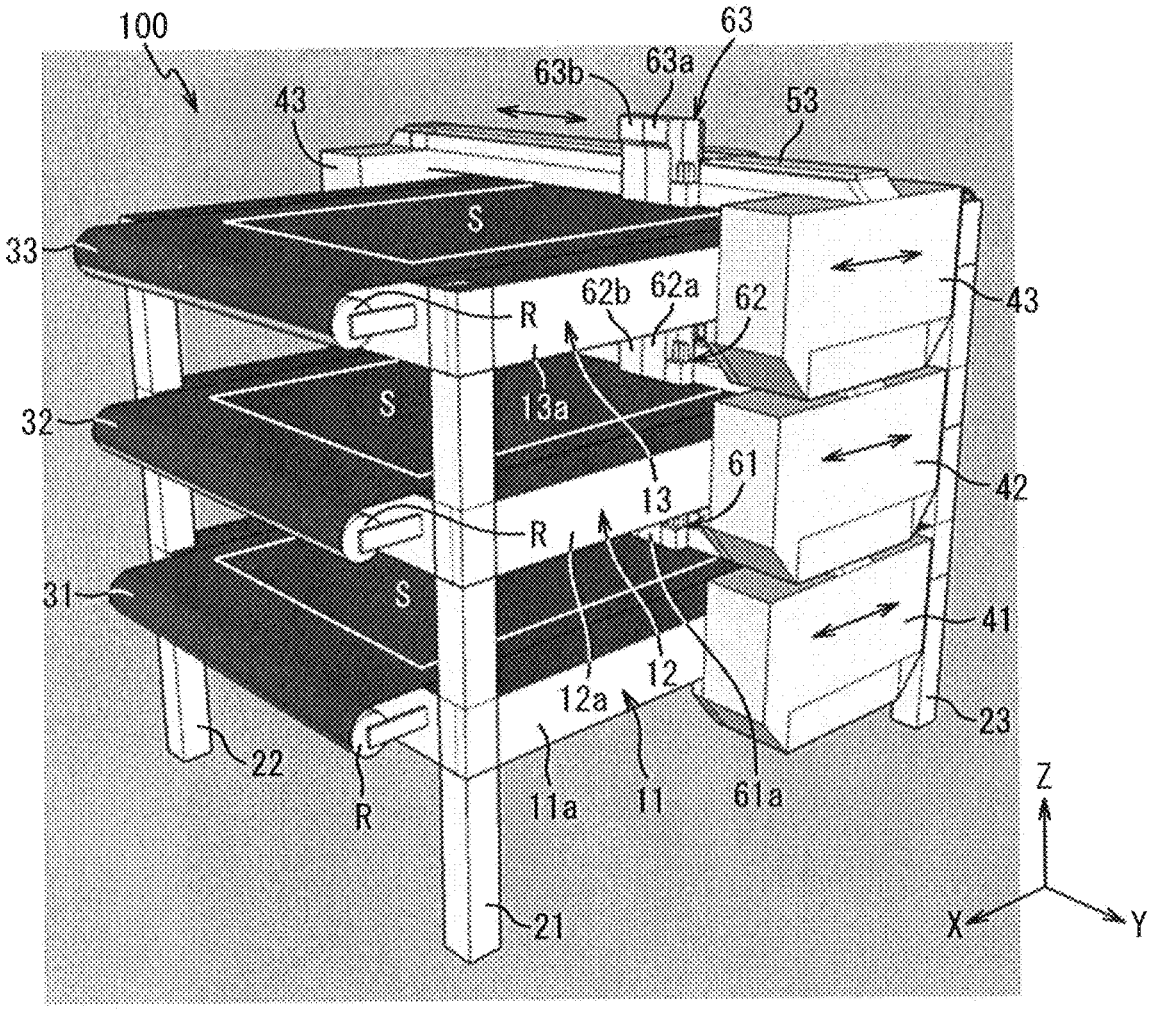
FIG. 2B is a second front perspective view of the multilayer-type sheet processing apparatus.
Figure 3A:
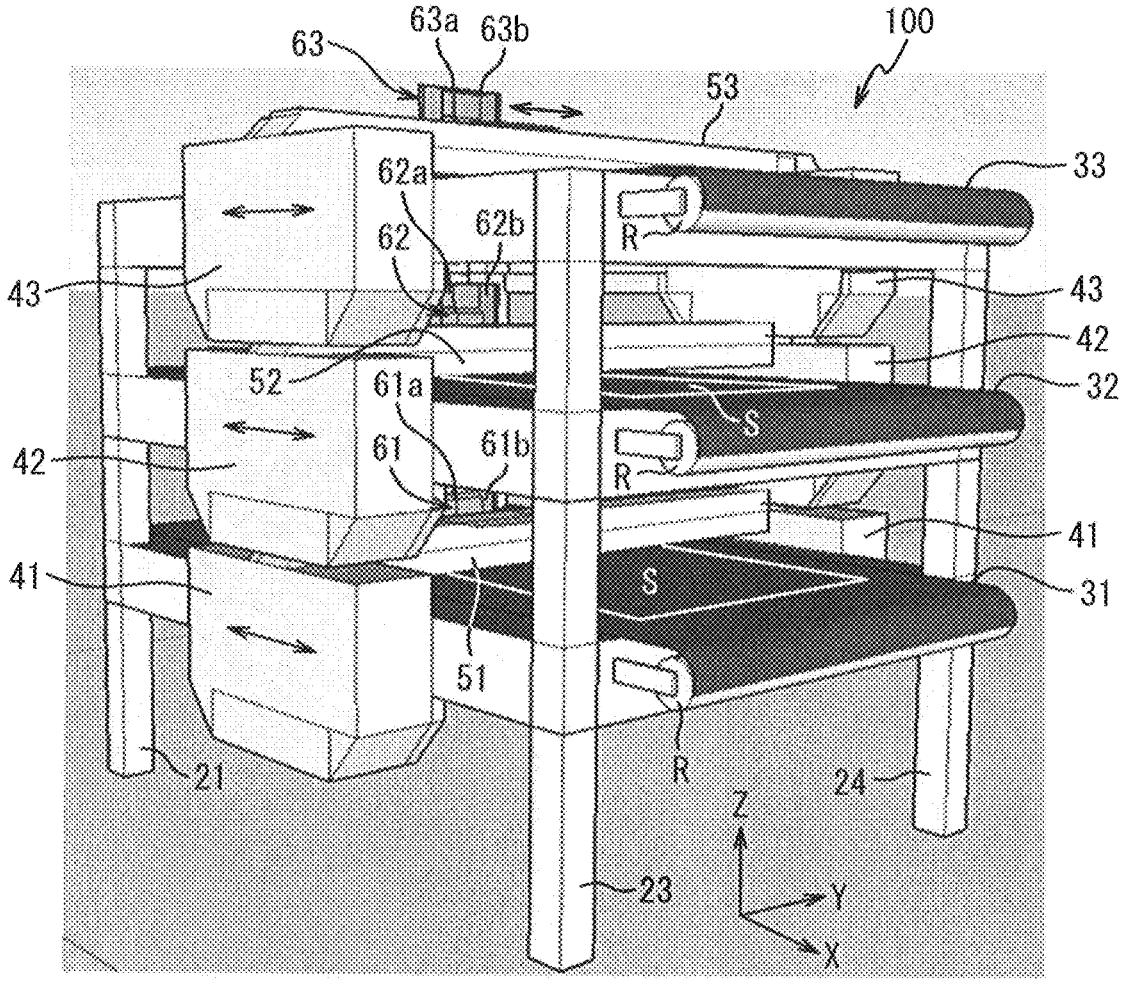
FIG. 3A is a first rear perspective view of the multilayer-type sheet processing apparatus.
Figure 3B:
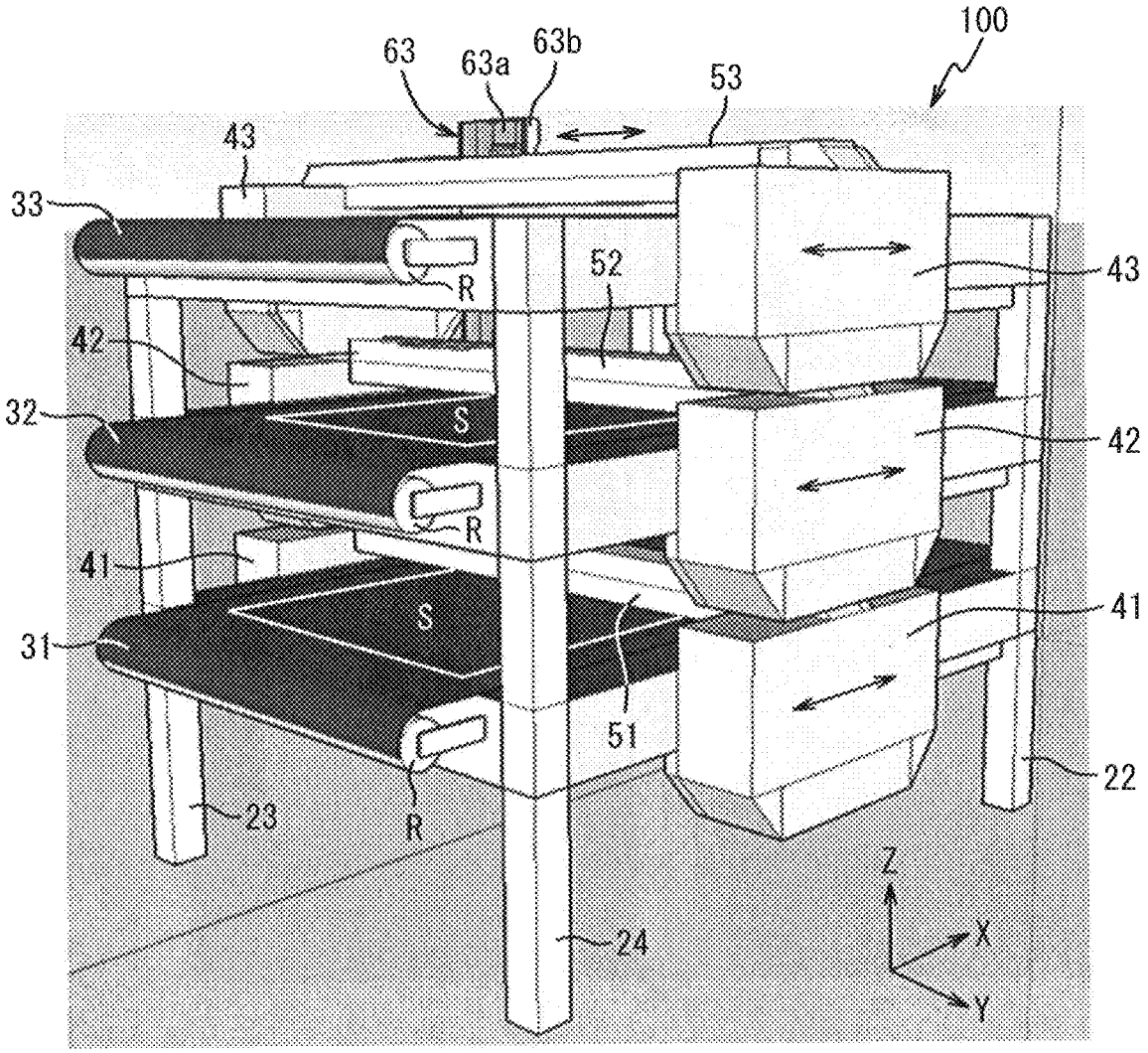
FIG. 3B is a second rear perspective view of the multilayer-type sheet processing apparatus.

When one of the rollers R of each of the machine frames 11*a* to 13*a* is driven, the conveying belts 31 to 33 are moved in an X-direction in synchronization therewith from a near side to a far side in FIG. 2A and FIG. 2B. A work area for processing the sheet S is formed on each of the conveying belts 31 to 33. The work area is arranged in a plane including the X-direction and a Y-direction.

Sheet feeding devices (not shown) are arranged on the near side of the conveying belts 31 to 33 in FIG. 2A and FIG. 2B. Sheets S that have not been processed are carried in from the sheet feeding devices to the conveying belts 31 to 33 intermittently in a horizontal direction, and three sheets are set on predetermined positions (work areas) on the conveying belts 31 to 33 at the same time.

Multilayer Structure of Processing Unit

Figure 4:
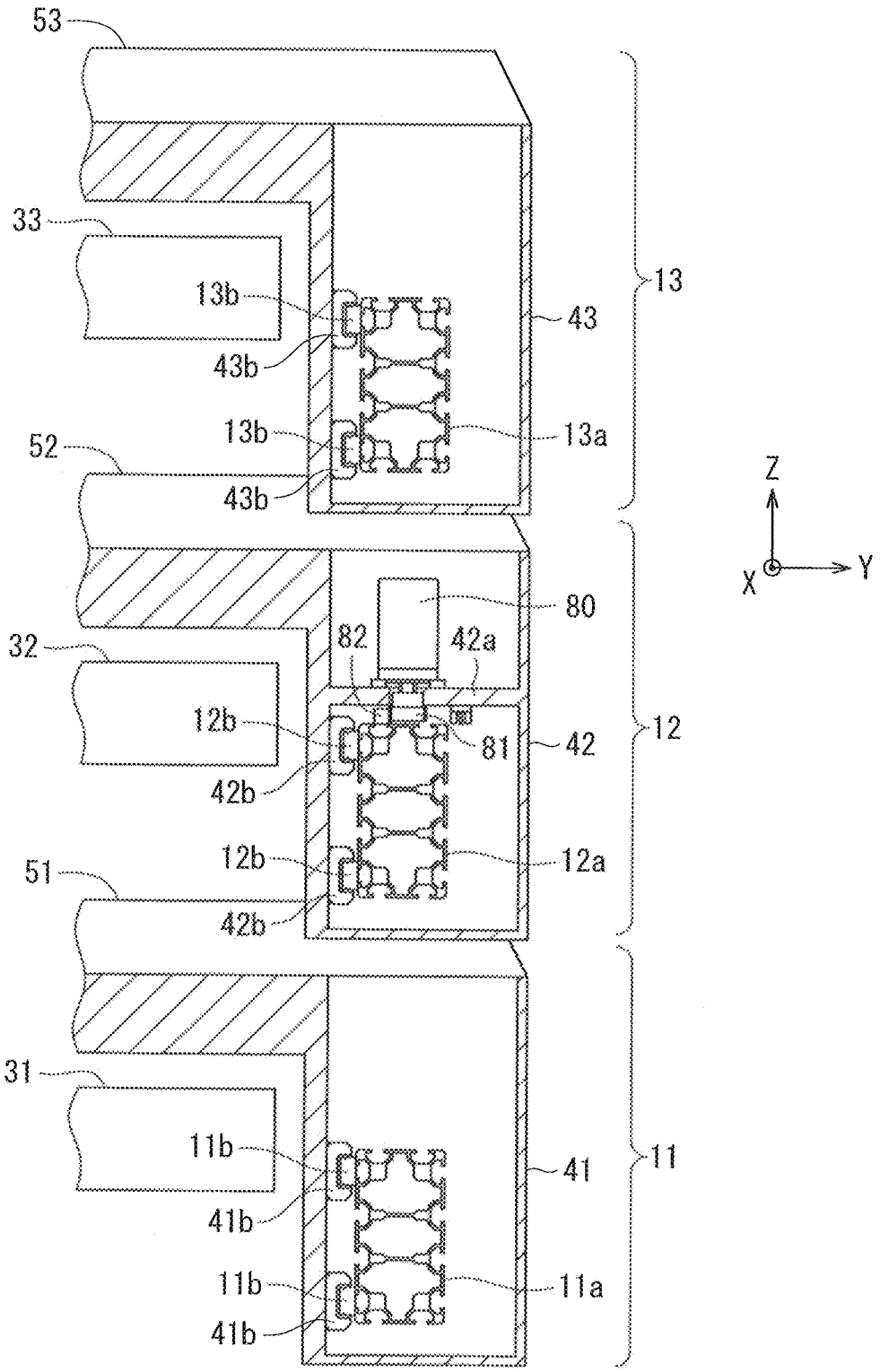
FIG. 4 is a partially enlarged sectional view of the multilayer-type sheet processing apparatus.

As illustrated in FIG. 4, the processing units 11 to 13 comprise first moving bodies 41 to 43 on both right and left sides with respect to a conveying direction of the conveying belts 31 to 33. In FIG. 4, only the first moving bodies 41 to 43 on one side (right side) are illustrated. However, the first moving bodies 41 to 43 are arranged similarly on an opposite side (left side) across the conveying belts 31 to 33.

The first moving bodies 41 to 43 are coupled to each other in the up-and-down direction (Z-direction) so as to be integrated. The integrated first moving bodies 41 to 43 are arranged so as to be movable along first guide members 11*b* to 13*b* fixed to side surfaces of the machine frames 11*a* to 13*a*.

That is, pairs of upper and lower first guide members 11*b* to 13*b* are arranged on inner surfaces of the machine frames 11*a* to 13*a* in parallel to each other. The longitudinal direction of the first guide members 11*b* to 13*b* is parallel to the conveying direction of the conveying belts 31 to 33 (X-direction). As illustrated in FIG. 4, the first moving bodies 41 to 43 of the processing units 11 to 13 comprise sliding portions 41*b* to 43*b* on side surfaces of vertical plates, and the sliding portions 41*b* to 43*b* engage with the first guide members 11*b* to 13*b* so as to be slidable in the X-direction.

The first moving body 42 at the intermediate position comprises a sliding motor (X-motor) 80, a pinion 81, and a rack 82, which serve as an X-drive mechanism configured to move the entirety of the three first moving bodies 41 to 43 in the X-direction. The sliding motor 80 is fixed on a horizontal arm portion 42*a* of the first moving body 42 so that an axial line thereof extends vertically.

A rotation shaft of the sliding motor 80 penetrates through the arm portion 42*a* to project above the machine frame 12*a*, and the pinion 81 is fixed to the projecting end of the rotation shaft. The pinion 81 meshes with the rack 82, which is fixed to an upper surface of the machine frame 12*a* and extends in the X-direction. Therefore, through drive of the sliding motor 80, the entirety of the three first moving bodies 41 to 43 is movable in a reciprocating manner along the first guide members 11*b* to 13*b*.

The first moving bodies 42 to 43 on both the sides of the machine frames 11*a* to 13*a*, which are opposed to each other, are coupled to each other by second guide members 51 to 53 in the horizontal direction (Y-direction). The second guide members 51 to 53 are arranged so as to extend in the Y-direction across spaces above the work areas on the conveying belts 31 to 33.

Second moving bodies 61 to 63 are arranged on the second guide members 51 to 53 so as to be movable along a longitudinal direction thereof the second guide members 51 to 53, that is, along the Y-direction. The second moving bodies 61 to 63 comprise tools configured to form processing lines (creasing lines or cutting lines) on the sheets S carried in to the work areas on the conveying belts 31 to 33.

The tools each comprise a creasing member 210 and a cutter blade 310. The creasing members 210 are retained by creasing mechanisms 61*a* to 63*a* in FIG. 5. The cutter blades 310 are retained by cutting mechanisms 61*b* to 63*b* in FIG. 6. In this embodiment, the creasing mechanisms 61*a* to 63*a* and the cutting mechanisms 61*b* to 63*b* are arranged adjacent to each other on the second moving bodies 61 to 63.

Creasing Mechanism

Figure 5:
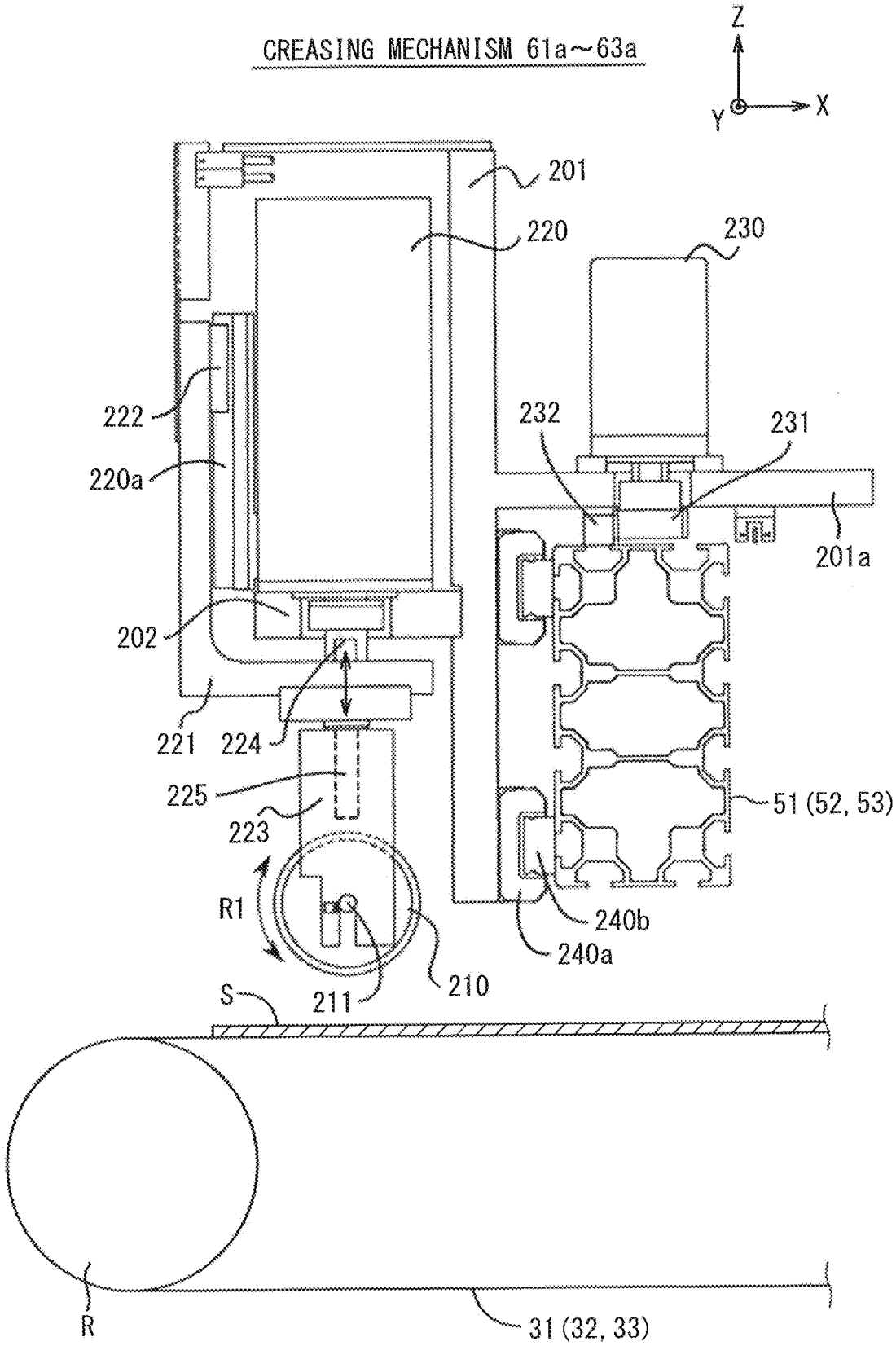
FIG. 5 is a schematic sectional view of a creasing mechanism.

The creasing mechanisms 61*a* to 63*a* in FIG. 5 each comprise, specifically, a frame 201 forming a main body part of corresponding one of the second moving bodies 61 to 63, a bracket 202 fixed to the frame 201, the creasing member 210, a roller retaining member 223, a guide member 221, an up-and-down motion motor 220, a sliding portion 222, a sliding motor 230, a pinion 231, a rack 232, a sliding portion (slider) 240*a*, and a guide portion (rails) 240*b*. The sliding motor (Y-motor) 230, the pinion 231, and the rack 232 form a Y-drive mechanism configured to drive the second moving bodies 61 to 63 along the second guide members 51 to 53.

The creasing member 210 is formed of a circular plate. The circular plate has a shape in which a thickness of an outer edge portion is gradually reduced so that a peripheral edge is sharpened. A center shaft 211 of the creasing member 210 is retained to the roller-retaining member 223 so as to be freely rotatable, and the creasing member 210 is rotatable in an direction.

The up-and-down motion motor 220 is fixed to the frame 201 through intermediation of the bracket 202. The roller-retaining member 223 is retained to a shaft 224 of the up-and-down motion motor 220 through intermediation of the guide member 221 so as to be turnable about a rotation shaft 225 that is coaxial with the shaft 224.

With this, in accordance with a force received by the creasing member 210, the orientation of the creasing member 210 is freely changed. The up-and-down motion motor 220 has a ball screw mechanism. Through rotation of the ball screw mechanism, the shaft 224 projects and retracts in the Z-direction (up-and-down direction).

The guide member 221 is fixed to the shaft 224, and extends upward along a side surface of the up-and-down motion motor 220. The sliding portion 222 is fixed to an upper end portion of the guide member 221. The sliding portion 222 is mounted to a rail 220*a* so as to be slidable. The rail 220*a* is mounted to the side surface of the up-and-down motion motor 220 so as to extend in the Z-direction. The sliding portion 222 is moved in the Z-direction along the rail 220*a*, and along therewith, the creasing member 210 is also moved in the Z-direction (up-and-down direction) through intermediation of the guide member 221.

The frame 201 comprises an arm portion 201*a* extending in the X-direction above corresponding one of the second guide members 51 to 53, and the sliding motor 230 is fixed on the arm portion 201*a* so that an axial line thereof extends vertically. A rotation shaft of the sliding motor 230 penetrates through the arm portion 201*a* to project above corresponding one of the second guide members 51 to 53, and the pinion 231 is fixed to the projecting end of the rotation shaft. The pinion 231 meshes with the rack 232, which is fixed to an upper surface of corresponding one of the second guide members 51 to 53 and extends in the Y-direction.

A pair of upper and lower sliders 240*a* are mounted to a side surface of a lower end portion of the frame 201. Meanwhile, a pair of upper and lower rails 240*b* extending in the Y-direction are fixed to a side surface of corresponding one of the second guide members 51 to 53. The pair of upper and lower sliders 240*a* are mounted to the pair of upper and lower rails 240*b* so as to be slidable relative to the pair of upper and lower rails 240*b*. With this configuration, through rotation of the sliding motor 230, the frame 201 and the creasing member 210 supported to the frame 201 slide in the Y-direction.

Before creasing is started, a controller (not shown) drives the sliding motor 230 to rotate the pinion 231. With this, the frame 201 is moved in a ±Y-direction to arrange the creasing member 210 at a position at which the creasing on the sheet S is performed. Further, when the creasing is to be started, the controller drives the up-and-down motion motor 220 to cause the shaft 224 to project from a main body of the motor 220 so that the creasing member 210 is pressed against a start position of the creasing on the sheet S. An amount (depth) of pressing the creasing member 210 against the sheet S is finely adjusted in accordance with a thickness or a material of the sheet S through control of the drive of the up-and-down motion motor 220.

Cutting Mechanism

Figure 6:
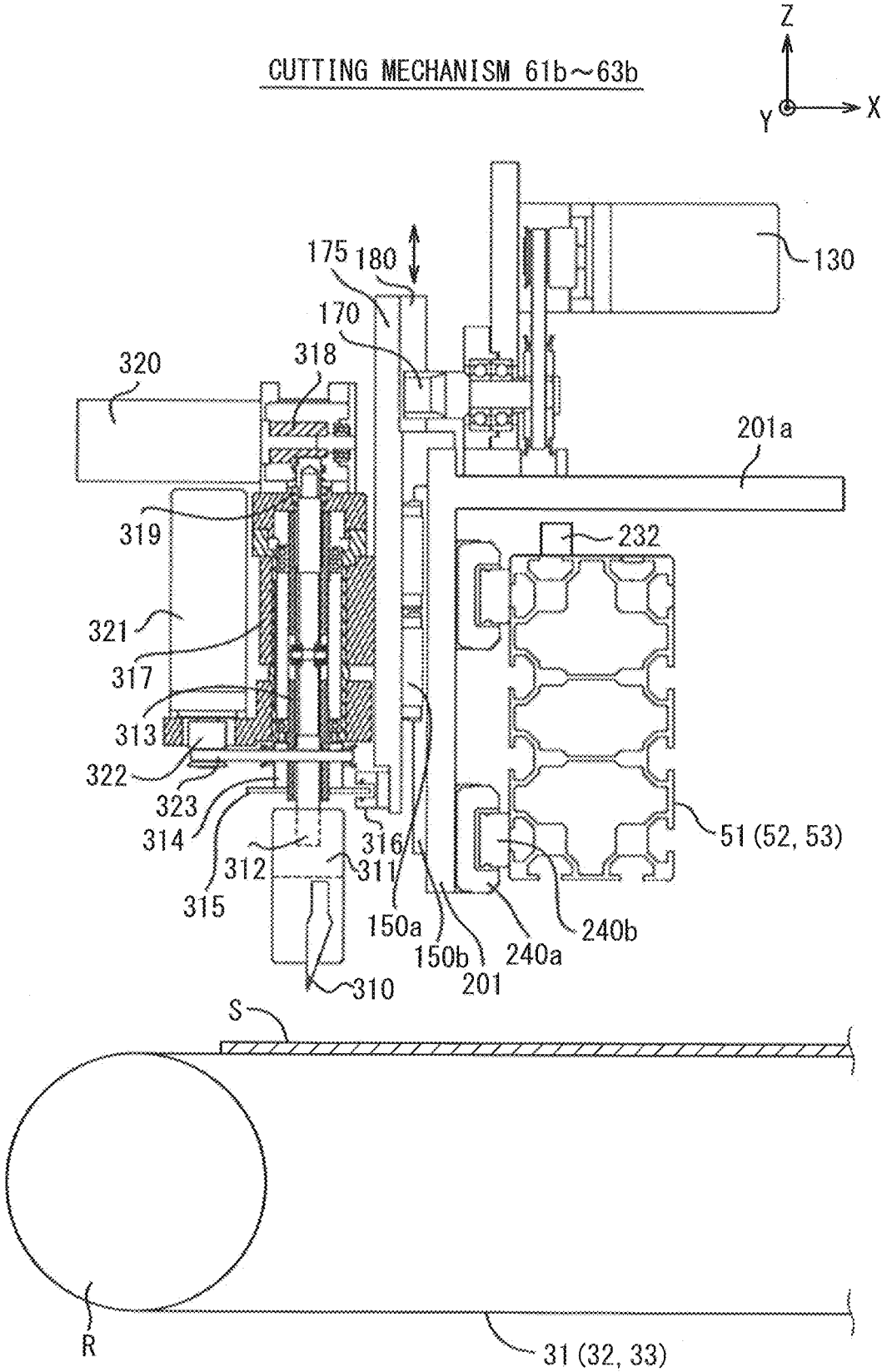
FIG. 6 is a schematic sectional view of a cutting mechanism.

As illustrated in FIG. 6, the cutting mechanisms 61*b* to 63*b* in FIG. 6 each comprise, specifically, the cutter blade 310, a cutter holder 311, a cutter shaft 312, a sleeve 313, a pulley 314, a detection plate 315, a sensor 316, a housing 317, an eccentric cam 318, a compression spring 319, a vibration motor 320, an angle adjustment motor 321, a pulley 322, and a timing belt 323.

The cutter blade 310 is removably mounted to the cutter holder 311. The cutter holder 311 is fixed to the cutter shaft 312. The cutter shaft 312 is retained in the sleeve 313 so as to be movable in a center axis direction of a predetermined stroke (Z-direction)

The sleeve 313 is retained in the housing 317 so as to be rotatable about the center axis of the cutter shaft 312. The pulley 314 is coaxially fixed to the sleeve 313. The pulley 314 is coupled by the timing belt 323 to the pulley 322 coaxially fixed to a rotation shaft of the angle adjustment motor 321. The detection plate 315 is fixed to the pulley 314, and the sensor 316 detects the detection plate 315.

Through rotation of the angle adjustment motor 321, the pulley 322 is rotated, and, through the rotation of the pulley 322, the pulley 314 and the sleeve 313 fixed to the pulley 314 are rotated through intermediation of the timing belt 323. When the sleeve 313 is rotated, the cutter shaft 312 is also rotated in the sleeve 313, and the cutter blade 310 retained to the cutter holder 311 is rotated about a Z-axis. A rotation amount of the cutter blade 310 can be measured through detection of the detection plate 315 by the sensor 316.

The vibration motor 320 is fixed to an upper portion of the housing 317. The eccentric cam 318 is fixed to a rotation shaft of the vibration motor 320. The eccentric cam 318 is arranged on an upper portion of the cutter shaft 312. The cutter shaft 312 is urged upward by the compression spring 319 so that an upper end portion thereof is held in abutment against the eccentric cam 318.

When the vibration motor 320 is rotated, the eccentric cam 318 is also rotated, and the cutter shaft 312 held in abutment against the eccentric cam 318 is moved in an axial direction of the cutter shaft 312. With this, the cutter blade 310 vibrates in the axial direction of the cutter shaft 312.

The housing 317 is fixed to a base 175. A slider 150*a* is fixed to the base 175. The slider 150*a* is retained to a rail 150*b* so as to be slidable. The rail 150*b* is fixed to the frame 201 and extends in the Z-direction.

A rack 180 extending in the Z-direction is fixed to the base 175. A pinion 170 meshes with the rack 180. The pinion 170 is driven by an up-and-down motion motor 130 fixed to the frame 201.

When the up-and-down motion motor 130 is rotated, the pinion 170 is rotated to move the rack 180 in the Z-direction. Along with the movement of the rack 180, the base 175 is also moved in the Z-direction, and the cutter blade 310 retained to the base 175 is moved in the Z-direction.

Before cutting is performed, the controller drives the sliding motor 230 in FIG. 5 to rotate the pinion 231. With this, the frame 201 is moved in the ±Y-direction to arrange the cutter blade 310 at a position at which the cutting on the sheet S is performed. Next, the controller drives the angle adjustment motor 321 so that the orientation of the cutter blade 310 matches an orientation of a cutting line to be formed (orientations of the X-direction and the Y-direction).

Next, the vibration motor 320 is driven to apply vibration in the Z-direction to the cutter blade 310. When the cutting is to be started, the up-and-down motion motor 130 is driven. With this, the cutter blade 310 is moved to the position of cutting the sheet S. After that, under a state in which the position of the cutter blade 310 is fixed, the sheet S is moved in the X-direction to form the cutting line on the sheet S.

Alternatively, as necessary, the cutter blade 310 is moved in the X-direction while the sheet S is being fixed. Also in this manner, a cutting line can be formed on the sheet S. The sheet S is cut while the cutter blade 310 is vibrated, thereby forming the cutting line extending in the X-direction.

Modification Embodiment of Y-drive Mechanism

Figure 7:
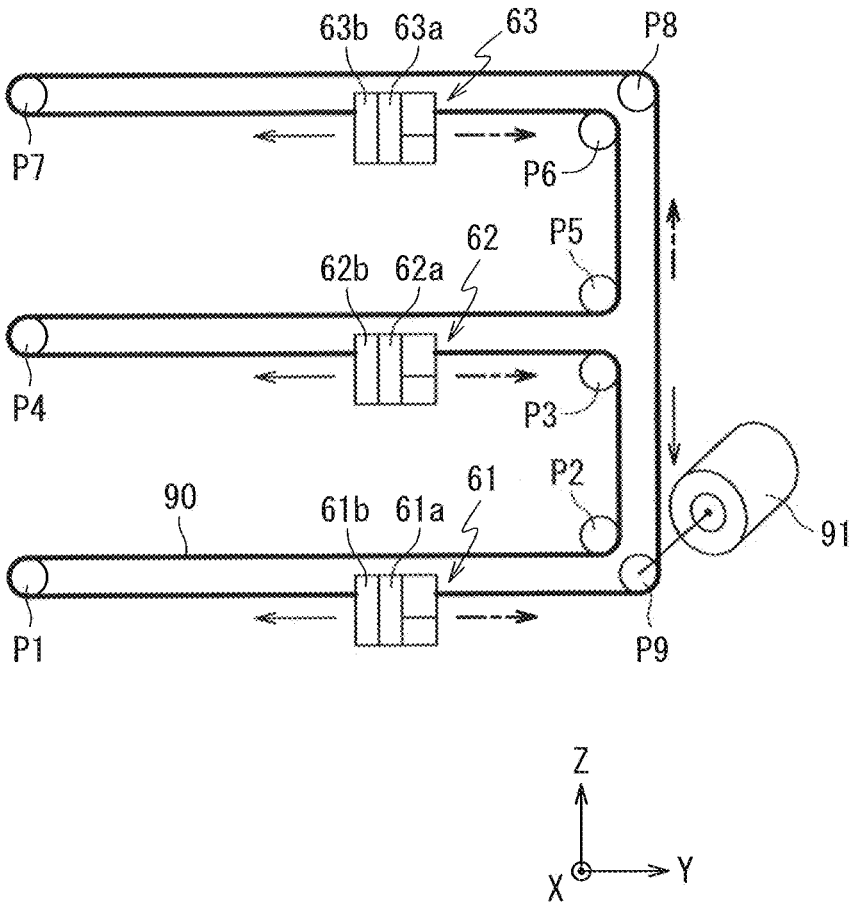
FIG. 7 is a schematic configuration view for illustrating a modification embodiment of a Y-drive mechanism.
Figure 8A:
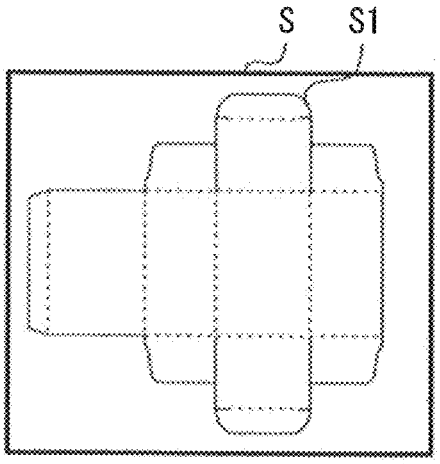
FIG. 8A is a view for illustrating an example of processing on a sheet.
Figure 8B:
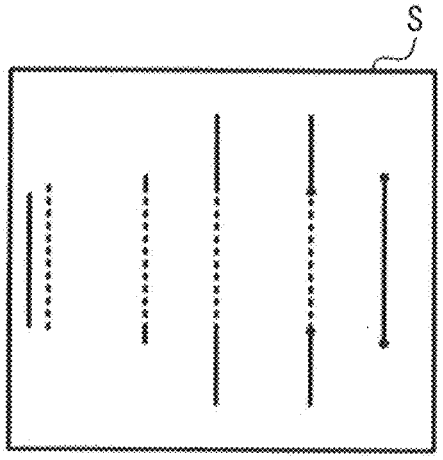
FIG. 8B is a view for illustrating the example of processing on a sheet.
Figure 8C:
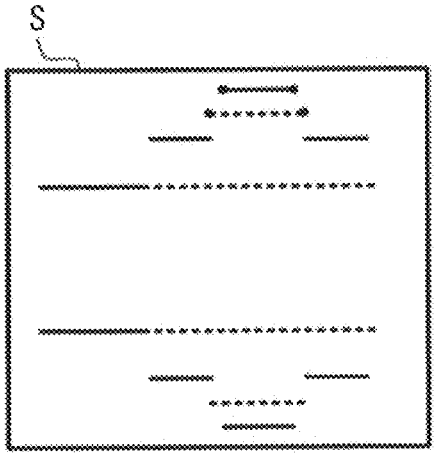
FIG. 8C is a view for illustrating the example of processing on a sheet.
Figure 8D:
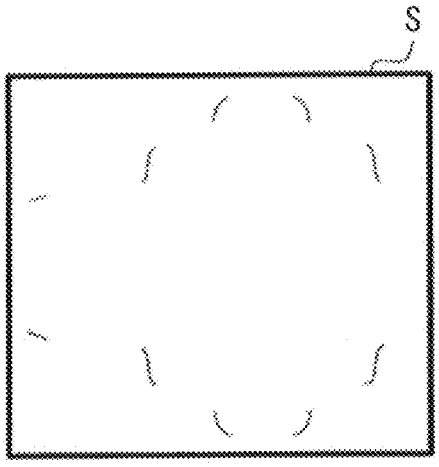
FIG. 8D is a view for illustrating the example of processing on a sheet.

The Y-drive mechanism described above is arranged for each of the processing units, and is capable of being independentlY-driven. However, it is not always required that the Y-drive mechanism be arranged for each of the processing units FIG. 7 is an illustration of a modification embodiment of the Y-drive mechanism. As is apparent from FIG. 7, the Y-drive mechanism comprises a circulating belt (Y-driving belt) 90 and a motor (common Y-motor) 91 configured to drive the circulating belt 90.

The circulating belt 90 is stretched along the second guide members 51 to 53 of the processing units 11 to 13 by a plurality of pulleys P1 to P9. Through forward and reverse drive of the driving pulley P9 by the motor 91, the circulating belt 90 can be driven in the direction of the solid-line arrows or the direction of the dashed line arrows.

The second moving bodies 61 to 63 configured to support the creasing mechanisms 61*a* to 63*a* and the cutting mechanisms 61*b* to 63*b*, which are described above, are coupled to the circulating belt 90, and, through drive of the motor 91, the creasing mechanisms 61*a* to 63*a* and the cutting mechanisms 61*b* to 63*b* of the processing units 11 to 13 are driven to the same positions. In the modification embodiment, the Y-drive mechanism can be simplified, thereby being capable of further reducing cost.

Creasing and Cutting

Processing on the sheet S by the sheet processing apparatus 1 is performed, for example, as illustrated in FIG. 8A to FIG. 8D. FIG. 8A to FIG. 8D are illustrations of an example of obtaining a developed sheet S1 of a box from the sheet S by the creasing and the cutting. In FIG. 8A to FIG. 8D, the solid lines indicate cutting lines, and the broken lines indicate creasing lines, which form a shape of a developed diagram of the box as a whole. The sheet S is set on a predetermined work area on each of the conveying belts 31 to 33 so that a U axis is parallel to the X-direction, and a V axis is parallel to the Y-direction.

The embodiment of the present invention is described above. However, the present invention is not limited to the embodiment, and various modifications may be made thereto based on technical idea described in the scope of claims. For example, in the embodiment, the processing units 11 to 13 are formed so as to have a three-layer structure. However, the processing units may be formed so as to have a freely selected multilayer structure such as a two-layer structure, a four-layer structure, or a five-layer structure. Further, it is not always required that processing units be stacked in a vertical direction in the multilayer structure. A multilayer structure in which processing units are stacked in an inclined state may be employed.

Further, in the embodiment, in the case of the three-layer structure, as in illustrated FIG. 4, the sliding motor 80, the pinion 81, and the rack 82 are arranged as the X-drive mechanism in the processing unit 12 provided at the intermediate position. However, the X-drive mechanism may be arranged in a freely selected processing unit among the three layers. Further, the X-drive mechanism may be arranged in each of the plurality of processing units as necessary. In this case, the plurality of X-drive mechanisms are synchronized with each other. For example, in the processing apparatus having the three-layer structure in FIG. 4, there may be employed a structure in which the X-drive mechanisms synchronized with each other are arranged only in the upper and lower processing units 11 and 13, and the X-drive mechanism is omitted from the processing unit 12 at the intermediate position.

Further, in the embodiment, the X-drive mechanism is arranged in the processing unit 12. However, the X-drive mechanism may comprise an X-driving belt stretched along the first guide member and coupled to the first moving body, and an X-motor on the machine frame side, which is configured to drive the X-driving belt. When the X-drive mechanism is arranged on the fixing side as described above, the weights of the processing units 11 to 13 are reduced, thereby being capable of reducing a load on the X-drive mechanism and increasing the speed of the first moving bodies 41 to 43.

Similarly, the Y-drive mechanism may comprise a Y-driving belt stretched along the second guide member and coupled to the second moving body, and a Y-motor on the second guide member side, which is configured to drive the Y-driving belt. With this, a load on the Y-drive mechanism can be reduced, and the speed of the second moving bodies 61 to 63 can be increased.

Further, in the embodiment, the creasing mechanisms 61*a* to 63*a* and the cutting mechanisms 61*b* to 63*b* are arranged so as to be adjacent to each other in the second moving bodies 61 to 63. However, in the processing units 11 to 13, two second moving bodies 61 to 63 may be arranged along the second guide members 51 to 53, and the creasing mechanisms 61*a* to 63*a* and the cutting mechanisms 61*b* to 63*b* may be arranged in different second moving bodies.

Further, in the embodiment, the creasing mechanisms 61*a* to 63*a* and the cutting mechanisms 61*b* to 63*b* are arranged in the second moving bodies 61 to 63. However, freely selected tools and mechanisms each configured to form a desired processing line on a sheet may be arranged in place of those creasing and cutting mechanisms. For example, in a sheet processing apparatus configured to cut a sheet such as a cloth with laser light, a cutting head configured to radiate laser light onto a sheet may be arranged in each of the second moving bodies 61 to 63.

Further, in the embodiment, the work areas for processing the sheet S are formed on the conveying belts 31 to 33. However, in place of the conveying belts 31 to 33, the work areas may be formed on work tables fixed to the machine frames 11*a* to 13*a*. An attraction unit having an air suction structure or other sheet fixing units may be arranged in the work table as necessary.

REFERENCE SIGNS LIST

11 to 13: processing unit, 11*a* to 13*a*: machine frame, 11*b* to 13*b*: first guide member, 21 to 24: support column, 31 to 33: conveying belt, 41 to 43: first moving body, 41*b* to 43*b*: sliding portion, 42*a*: arm portion, 51 to 53: second guide member, 61 to 63: second moving body, 61*a* to 63*a*: creasing mechanism, 61*b* to 63*b*: cutting mechanism, 80: sliding motor, 81: pinion, 82: rack, 90: circulating belt, 91: motor, 100: multilayer-type sheet processing apparatus, 130: up-and-down motion motor, 150*a*: slider, 150*b*: rail, 170: pinion, 175: base, 180: rack, 201: frame, 201*a*: arm portion, 202: bracket, 210: creasing member, 211: center shaft, 220: up-and-down motion motor, 220*a*: rail, 221: guide member, 222: sliding portion, 223: roller retaining member, 224: shaft, 225: rotation shaft, 230: sliding motor, 231: pinion, 232: rack, 240*a*: sliding portion, 240*b* guide portion, 310: cutter blade, 311: cutter holder, 312: cutter shaft, 313: sleeve, 314: pulley, 315: detection plate, 316: sensor, 317: housing, 318: eccentric cam, 319: compression spring, 320: vibration motor, 321: angle adjustment motor, 322: pulley, 323: timing belt, P1 to P9: pulley, R: roller, S: sheet, S1: developed sheet

The invention claimed is:

1. A multilayer-type sheet processing apparatus comprising a plurality of processing units, each of the plurality of processing units comprising:

a first guide member extending in an X-direction;

a first moving body arranged so as to be movable along the first guide member;

a second guide member, which is supported to the first moving body and extends in a Y-direction orthogonal to the X-direction;

a second moving body arranged so as to be movable along the second guide member;

a Y-drive mechanism configured to drive the second moving body along the second guide member; and a work area arranged in a plane including the X-direction and the Y-direction, wherein the second moving body comprises a tool moveable towards and away from the work area and configured to form a processing line on a sheet arranged on the work area, wherein the plurality of processing units are stacked so that the work areas of the plurality of processing units overlap with each other in a direction perpendicular to the X-direction and the Y-direction, wherein the first moving body of at least one processing unit of the plurality of processing units is driven along the first guide member by an X-drive mechanism, and wherein the first moving body that is moved by the X-drive mechanism and the first moving body of another processing unit of the plurality of processing units comprising no X-drive mechanism are coupled to each other.

2. The multilayer-type sheet processing apparatus according to claim 1, wherein the plurality of processing units is at least three processing units stacked in a vertical direction, and the first moving body of the processing unit at an intermediate position is capable of being driven by the X-drive mechanism, and wherein the first moving body of the processing unit at the intermediate position and the first moving bodies of other processing units provided on an upper side and a lower side with respect to the first moving body of the processing unit at the intermediate position are coupled to each other.

3. The multilayer-type sheet processing apparatus according to claim 1, wherein, for at least one of the plurality of processing units, the Y-drive mechanism comprises a Y-motor, and a pinion coupled to a rotation shaft of the Y-motor, and wherein the pinion is meshed with a rack formed along the second guide member.

4. The multilayer-type sheet processing apparatus according to claim 1, wherein, for at least one of the plurality of processing units, the Y-drive mechanism comprises a Y-driving belt stretched along the second guide member and coupled to the second moving body, and a Y-motor configured to drive the Y-driving belt.

5. The multilayer-type sheet processing apparatus according to claim 1, wherein the X-drive mechanism comprises an X-motor, and a pinion coupled to a rotation shaft of the X-motor, and wherein the pinion is meshed with a rack formed along the first guide member of the at least one processing unit.

6. The multilayer-type sheet processing apparatus according to claim 1, wherein the X-drive mechanism comprises an X-driving belt stretched along the first guide member of the at least one processing unit and coupled to the first moving body of the at least one processing unit, and an X-motor configured to drive the X-driving belt.

7. The multilayer-type sheet processing apparatus according to claim 1, wherein the Y-drive mechanisms of the plurality of processing units comprise a single common Y-driving belt stretched along the second guide members of the plurality of processing units to be moved in a circulating manner and coupled to the second moving bodies, and a single common Y-motor configured to drive the common Y-driving belt.

* * * * *